US008701689B2

(12) United States Patent
Warner

(10) Patent No.: US 8,701,689 B2
(45) Date of Patent: Apr. 22, 2014

(54) SADDLE SHAPED TENT WITH PORTICO

(75) Inventor: Gerhard Allan Warner, Surrey (CA)

(73) Assignee: 0798555 B.C. Ltd., Surrey, BC (CA)

( * ) Notice: Subject to any disclaimer, the term of this patent is extended or adjusted under 35 U.S.C. 154(b) by 0 days.

(21) Appl. No.: 13/023,296

(22) Filed: Feb. 8, 2011

(65) Prior Publication Data

US 2011/0197940 A1 Aug. 18, 2011

Related U.S. Application Data

(60) Provisional application No. 61/303,889, filed on Feb. 12, 2010.

(51) Int. Cl.

| | |
|---|---|
| ***E04H 15/34*** | (2006.01) |
| *E04H 15/58* | (2006.01) |
| *E04H 15/64* | (2006.01) |

(52) U.S. Cl.

USPC ..... 135/121; 135/117; 135/119; 135/906; 135/908

(58) Field of Classification Search

USPC ..... 135/121, 124, 115, 117, 119, 120.3, 135/906, 908, 133, 136; 52/63, 80.2

See application file for complete search history.

(56) References Cited

U.S. PATENT DOCUMENTS

| | | | | |
|---|---|---|---|---|
| 2,388,297 | A | 11/1945 | Slaughter | |
| 2,828,756 | A * | 4/1958 | Worley | 135/97 |
| 2,923,305 | A | 2/1960 | Cline | |
| 2,928,360 | A * | 3/1960 | Heine, Jr. | 52/80.2 |
| 2,986,150 | A | 5/1961 | Torian | |
| 3,060,949 | A * | 10/1962 | Moss | 135/87 |
| 3,137,097 | A * | 6/1964 | Zeinetz | 52/81.2 |
| 3,232,806 | A * | 2/1966 | Widmer | 156/212 |
| 3,255,467 | A * | 6/1966 | Kowalski | 135/16 |
| 3,388,711 | A * | 6/1968 | Huddle | 135/123 |
| 3,534,750 | A * | 10/1970 | Kolozsvary | 135/132 |
| 3,726,294 | A * | 4/1973 | Huddle | 52/63 |
| 3,798,849 | A * | 3/1974 | Biggs et al. | 52/80.2 |
| 3,811,454 | A | 5/1974 | Huddle | |
| 3,856,029 | A * | 12/1974 | Huddle | 135/132 |
| 3,875,623 | A | 4/1975 | Johnston | |
| 3,909,993 | A * | 10/1975 | Huddle | 52/63 |
| 3,982,361 | A | 9/1976 | Deutsch et al. | |
| 4,034,772 | A | 7/1977 | Huddle | |
| 4,036,244 | A * | 7/1977 | Huddle | 52/63 |
| 4,201,359 | A | 5/1980 | Baslow | |
| 4,452,294 | A | 6/1984 | Fukuchi | |
| 4,817,655 | A | 4/1989 | Brooks | |
| 4,878,322 | A | 11/1989 | Ikeda et al. | |

(Continued)

FOREIGN PATENT DOCUMENTS

| | | | |
|---|---|---|---|
| CH | 635393 | A5 | 3/1983 |
| DE | 3824142 | A1 | 1/1990 |
| EP | 0007580 | A1 | 2/1980 |
| GB | 2359312 | A | 8/2001 |

*Primary Examiner* — Noah Chandler Hawk

(74) *Attorney, Agent, or Firm* — Michael Best & Friedrich LLP

(57) ABSTRACT

Disclosed herein is a portico for saddle-shaped tents. The portico includes a drape that is suspended from the saddle-frame of the saddle-shaped tent. The portico also includes a portico-frame that has a horizontal beam, which beam is attached to the lower edge of the drape. The portico-frame may also include posts. In one embodiment of the invention, the portico acts as a joiner to join two adjacent saddle-shaped tents. The invention includes tents and compound tent-structures that incorporate the portico.

13 Claims, 4 Drawing Sheets

(56) References Cited

U.S. PATENT DOCUMENTS

| | | | | |
|---|---|---|---|---|
| 4,942,895 | A | 7/1990 | Lynch | |
| 4,976,074 | A | 12/1990 | Delamare | |
| 5,080,423 | A | 1/1992 | Merlot et al. | |
| 5,222,513 | A | 6/1993 | Hilliard | |
| 5,613,543 | A | 3/1997 | Walton | |
| 5,784,842 | A | 7/1998 | Wackerbauer | |
| 5,829,820 | A | 11/1998 | Cowsert | |
| 5,899,028 | A * | 5/1999 | Warner | 52/80.2 |
| 5,953,875 | A | 9/1999 | Harkins | |
| 6,345,638 | B1 | 2/2002 | Warner | |
| 6,474,022 | B1 | 11/2002 | Double et al. | |
| 6,564,513 | B2 | 5/2003 | Henbid et al. | |
| 6,701,948 | B2 * | 3/2004 | Jopp et al. | 135/97 |
| 6,832,571 | B2 | 12/2004 | Eagles | |
| 7,987,863 | B2 | 8/2011 | Warner | |
| 2007/0062567 | A1 * | 3/2007 | Warner | 135/97 |

* cited by examiner

SADDLE SHAPED TENT WITH PORTICO

CROSS-REFERENCE TO RELATED APPLICATION

Reference is made to U.S. Provisional Patent Application No. 61/303,889 filed on Feb. 12, 2010 with respect to which priority is claimed pursuant to 35 U.S.C. §119(e).

BACKGROUND OF THE INVENTION

1. Field of the Invention

The present invention relates to a saddle-shaped tents.

2. Existing Art

Saddle-shaped tents, also referred to as "saddle-tents" and "saddle-span tents," are well known in the art of tents and shelters. The meaning of the term saddle-shaped tent is best understood by referring to FIG. 1, which shows a prior art saddle-shaped tent 100 erected over a surface 104. Horizon line 105 is provided in the figure to help orient the viewer.

Such tents typically include a fabric membrane, referred to herein as a "canopy" 107, that is attached to a saddle-shaped tent frame. The canopy may be made of a single piece of fabric, and it may be pre-formed.

The term "saddle-tent frame" is used herein to mean a frame that supports the canopy of a saddle-shaped tent. Saddle-tent frames are generally made of two arcuate members 109*a*, 109*b*. Each arcuate member has an apex 110*a*, 110*b* and two ends. Because FIG. 1 is a side view, only one end 108*a*, 108*b* of each arcuate member is shown. The adjacent ends 108*a*, 108*b* of the two arcuate members 109*a*, 109*b* may be attached to one another. These ends, whether or not they are attached to each other, may rest on the surface, a plate, a base, a block, or other support structure. Once the canopy is attached the apices 110*a*, 110*b* of the arcuate members are lifted above the surface 104 to provide a covered space under the canopy. A plurality of guy wires 106*a*, 106*b*, secure the tent to the surface.

As will be appreciated from FIG. 1, that when viewed from the side, the saddle-shaped tent 100 has an approximately triangular periphery. The arcuate members 109*a*, 109*b* form the sides of the triangle and the upper surface 101 of the canopy 107 forms the hypotenuse. When viewed from the side as in FIG. 1, the upper surface 101 of the canopy 107 is bowed downwards, thus producing the saddle that gives the tent its name.

The basic saddle-shaped tent provides excellent protection from the sun; it also provides superb acoustics. For these reasons the saddle-shaped tent is a popular choice for stage covers for outdoors musical and speaking events. Because they are easy to assemble and disassemble saddle-shaped tents are also frequently used as party tents, logo tents, event tents, and temporary shelters. However, because the ends of the saddle-shaped tent are open, the basic saddle-shaped tent does not provide complete protection from wind or rain, particularly rain falling with a significant horizontal trajectory. Consequently, drapes may be attached to the saddle-frame at one or both ends of the tent if it is necessary to provide users with complete protection from the elements.

FIG. 2 shows a prior art example of a saddle-shaped tent having such a drape 200 suspended from the saddle-frame to the ground. As used herein the term "drape" refers to a flexible or fabric sheet or membrane that hangs downward from a saddle-frame and encloses at least a portion of the area under the tent. Although such drapes may be used at both ends of the tent, they are generally used only at one end as shown in FIG. 2 in order to block wind flow through the protected space and greatly reduce rain penetration into the protected space without cutting off all of the light or destroying the open-air ambiance.

Saddle-shaped tents employing simple drapes as shown in FIG. 2 have significant shortcomings. For instance, the wind load the drapes can carry is limited, and it is difficult to make the drapes sufficiently taut to eliminate distracting movement and noise. Also, it is difficult or impossible to provide doors and windows in the drapes.

SUMMARY OF THE INVENTION

According to the invention there is provided a portico for a saddle-shaped tent for enclosing an end of the tent or for joining tents together.

The portico includes a drape and a portico-frame. The portico-frame includes a horizontal beam attached to the bottom edge of the drape, and posts that connect to the horizontal beam. The posts are supported by the surface upon which the tent is erected. The drape may be an extension of the tent canopy or, alternatively, it may be separately attachable to the frame and/or the canopy. The drape may be pre-formed to be curved when the tent is assembled. For example, it may be anti-clastic.

Panels may be attached to the portico-frame to form a portico-wall. When attached to the portico-frame, the panels are oriented generally vertically. The panels may include doors and windows. The panels may be made of a flexible material such as canvas, or they may be made of rigid materials, such as plywood.

Thus, the invention provides a number of advantages and functions not previously known in the art. The portico frame allows the inclusion of vertical or nearly vertical walls in a saddle-shaped tent. This, in turn, permits the use of interior space right up to the edge of the tent, even in inclement weather. The panels can be made of or include transparent materials to allow light to enter the tent without rain and wind, and to allow panoramic views from the interior of the tent. It is even possible to employ glass windows and doors, and it is also possible to use standard construction materials such as plywood and particle board as well as standard hardware, which simplifies design and construction and lowers costs.

The portico-frame system of the invention structurally isolates the vertical walls from the roof of the tent. The fabric of the portico above the frame serves as an auxiliary roof.

When two saddle-shaped tents are juxtaposed end-to-end, the invention can be used to join the two tents to provide a continuous, water-proof interior with centrally located windows and doors to maximize lighting and ease of ingress/egress.

BRIEF DESCRIPTION OF THE DRAWINGS

Further features and advantages of the invention will be apparent from the following detailed description of a preferred and exemplary embodiment, taken in conjunction with the accompanying drawings, wherein.

DETAILED DESCRIPTION OF THE INVENTION WITH REFERENCE TO THE DRAWINGS

Figure 1:
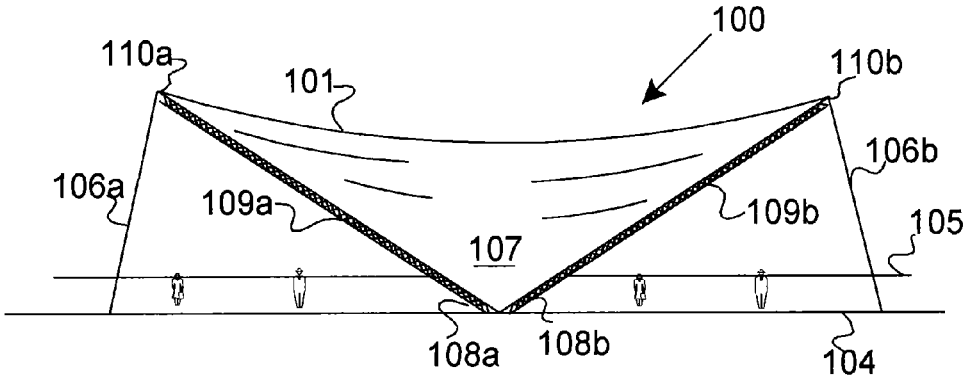
Fig 1. (Prior art)
FIG. 1 is a side view of a prior art saddle-shaped tent without any protection for the ends, as described above.
Figure 2:
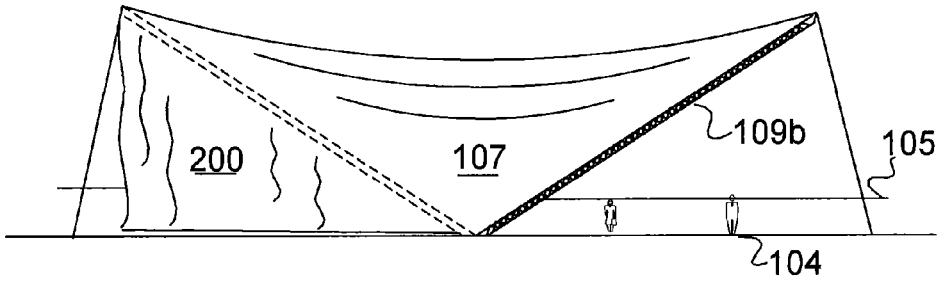
Fig 2. (Prior art)
FIG. 2 is a side view of a prior art saddle-shaped tent employing a simple drape at one end, as described above.
Figure 3:
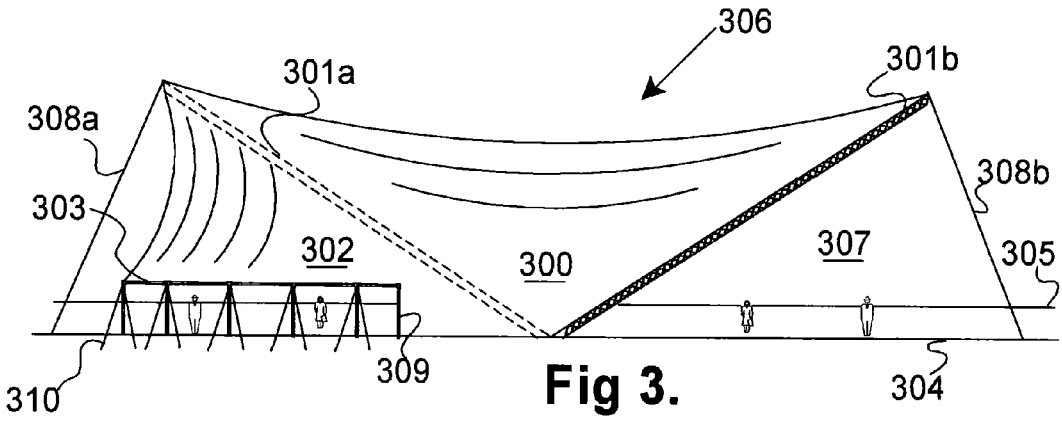
FIG. 3 is a side view of a saddle-shaped tent according to the invention employing a drape and portico-frame according to the invention.

FIG. 3 shows a preferred embodiment of a saddle-shaped tent 306 with a portico, according to the invention. The tent is erected over a surface to be enclosed 304 and has a canopy 300 attached to a saddle-frame comprising two arcuate members 301*a*, 301*b*, as described above. A plurality of guy lines or straps 308*a*, 308*b* secure the saddle-frame to the surface. Horizon line 305 is provided to orient the viewer.

One end of the tent shown in FIG. 3 is open 307. The opposite end of the tent is enclosed by the portico, which includes drape 302. The drape is either an extension of canopy 300 or is a separable member that is attached to the canopy or to the frame. Preferably the drape and canopy are made of strong and moderately inelastic fabric, such as canvas or nylon, but the invention is not limited by the material of the drape. The drape has a lower edge 600 (See FIG. 6).

The drape hangs generally downwards from the frame but may be cut so as to present a curved surface as shown in FIG. 3 in order to further enhance the acoustic advantages of the saddle-shaped tent and to streamline the drape to the wind. A concave or anti-clastic surface is preferred.

At least a portion of the lower edge of the drape is attached to a portico-frame. The portico-frame has a substantially horizontal beam 303, to which the lower edge of the drape is attached. The horizontal beam may be curved in order to follow the contour of the lower edge of the drape. Other portions of the lower edge of the drape may be attached directly to the surface 304. The portico frame may optionally include one or more vertical posts 309. Each post has an upper end that is attached to the horizontal beam and a lower end that is supported by the surface, either directly or by means of a plate, block, or base.

Thus, in the preferred embodiment the horizontal beam and the posts form the portico-frame, which is attached to the lower edge of at least a portion of the drape to form the portico. The frame is secured to the ground by means of guy wires 310, and therefore the portico acts as an additional grounding mechanism for stabilizing the tent.

Figure 4:
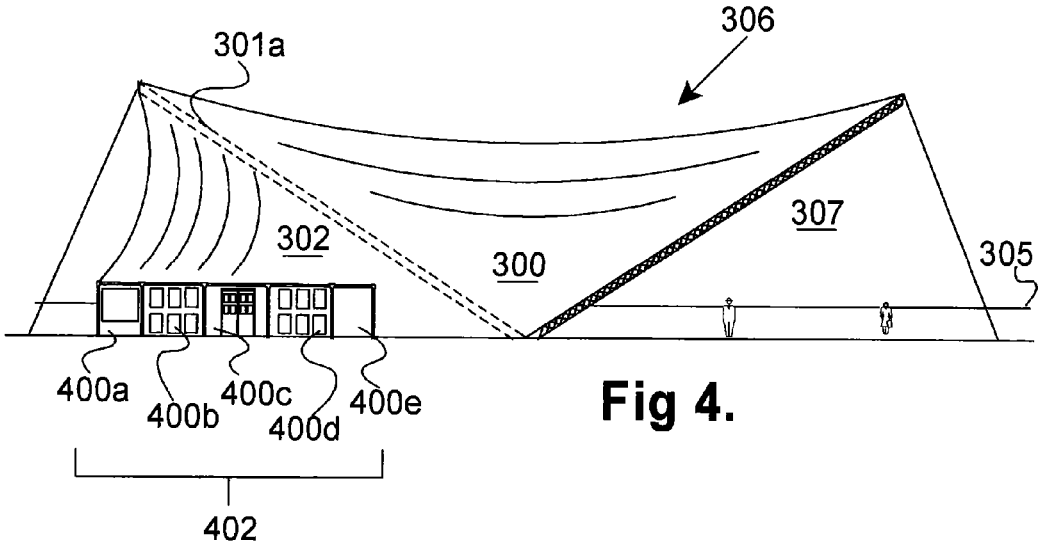
FIG. 4 is a side view of a saddle-shaped tent according to the invention employing a drape and portico-frame with panels or walls attached, according to the invention.

FIG. 4 shows windows, walls, doors, and the like 400*a-e*, that are provided by what are referred to collectively herein as "panels," which can be connected to the portico-frame, thereby forming a portico-wall 402. The portico-wall is generally vertically oriented; however, depending on design criteria of specific embodiments, the orientation of the portico-wall may substantially deviate from absolute vertical and still be within the scope of the invention.

Figure 5:
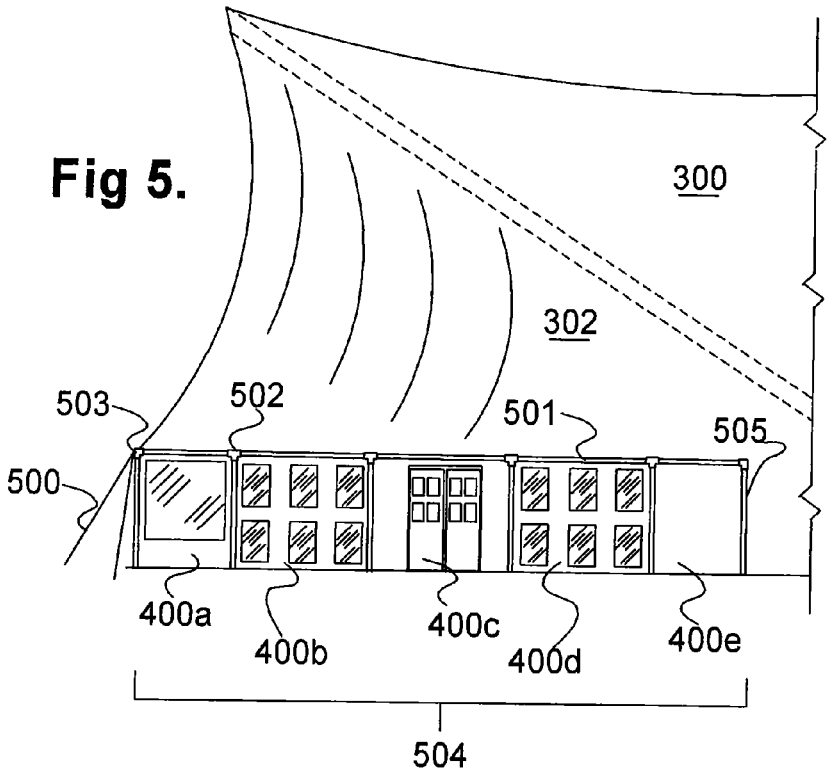
FIG. 5 is a more detailed view of one end of the saddle-shaped tent of FIG. 4.

FIG. 5 shows the portico of FIG. 4 in more detail. The figure shows just the closed end of the saddle-shaped tent. The portico is formed from the drape 302 and the portico-frame. If panels are employed to produce a portico-wall 504, the portico can completely seal the end of the tent while still providing access to light and egress/ingress for participants.

Horizontal beam 303 (See FIG. 3) is most conveniently provided by interconnecting a plurality of sections such as 501 into the beam on site. Sleeves, "tee" joints 502, elbow joints, and corners 503 may be used to secure the beam sections to one another and the to vertical posts 505. The vertical posts support the horizontal beam from beneath while the drape supports it from above. Guy wires or straps 500 may be used to secure the portico-frame to the surface in order to stabilize the structure and overcome wind loading. These panels when attached to the portico-frame thus provide multi-functional vertical walls.

Referring again to FIG. 4 panels 400*a-e* may take a variety of forms and serve a variety of functions. Panel 400*c*, for instance, is a doorway, while panel 400*a* is a "picture window". Panel 400*e* is solid and panels 400*b* and 400*d* have multiple smaller windows. The panels may be made of fabric and the fabric can be pre-tensioned to be flat and taut so as to appear to be drywall. Another option is to use panels made of ridged materials such as hard wall, ply-wood, and particle board and employ commercially available hard doors, electric doors, fire doors, and double safety doors. All of the panels comprising a portico-wall need not be made of the same material or serve the same purpose.

Figure 6:
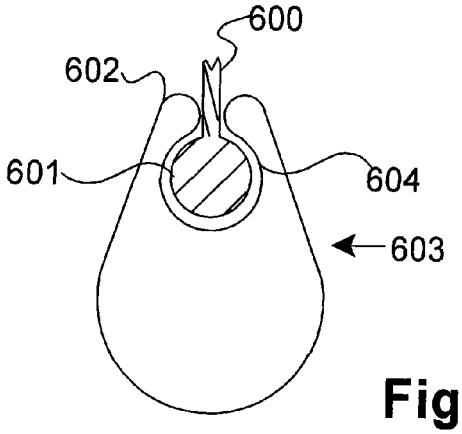
FIG. 6 is a perspective view of a saddle-shaped tent in combination with a drape, beam frame and panels/walls according to the invention.

A variety of ways for connecting the drape to the horizontal beam are possible and will be obvious to those of skill in the art after comprehending this disclosure. For instance, straps, hook and loop mechanisms, buckles, and circular clamps are all possible connectors. This variety contributes to the flexibility of the invention. In one preferred, exemplary embodiment the horizontal beam is connected to the lower edge of the drape by means of a keder rail. FIG. 6 shows a cross-section of such a horizontal beam 603 and keder rail 602 integrated into a single structure. In this embodiment, the lower edge 600 of the drape to which the horizontal beam connects is thickened or includes an elongate member 601 that is retained within the track 604 of the keder rail. This approach of attaching the membrane to the horizontal beam is particularly advantageous because sufficient force can be applied to the drape to insure that the drape fabric is taut while maintaining the connection between the horizontal beam and the drape. The keder rail also distributes the environmental and pre-stress loads from the drape into the frame, from whence the force is carried to ground through tensile forces in the guy lines.

Figure 7:
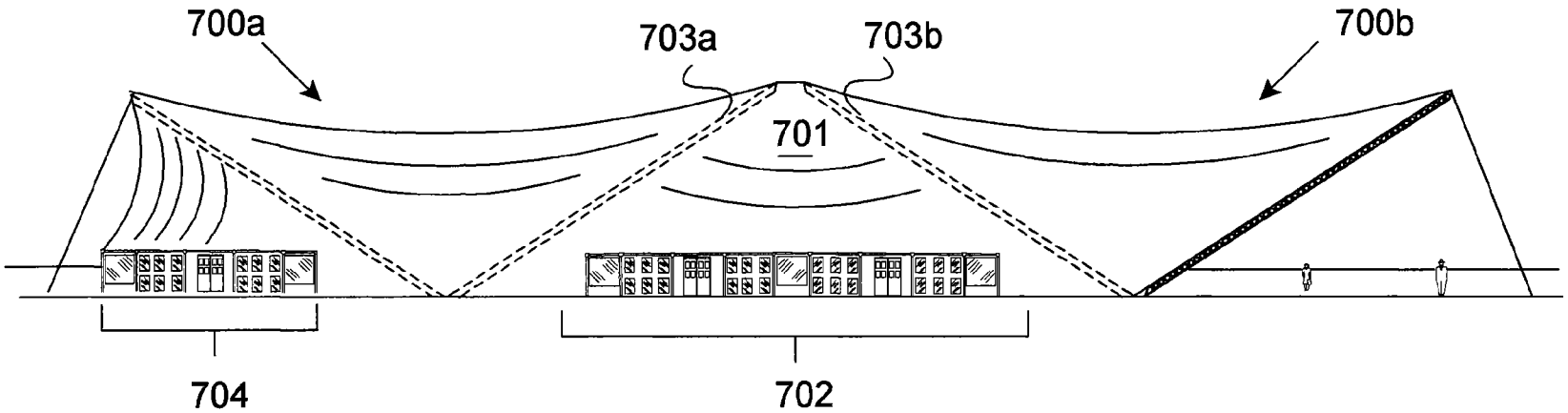
FIG. 7 illustrates the use of the invention as a joiner, wherein two tents are joined end-to-end.

One preferred use of the invention is as a joiner for joining two saddle-shaped tents into a compound tent structure. This may be accomplished as shown in FIG. 7. A first saddle-shaped tent 700*a* is juxtaposed in an end-to-end fashion to a second saddle-shaped tent 700*b*. The two tents are joined and the space between the two tents is enclosed by the portico of the invention employed as a joiner. Drape 701 is connected to the adjoining arcuate members 703*a* and 703*b* of both tents and hangs generally downward. This forms a roof of the joiner.

A portico wall structure 702 may be provided as described above, including a horizontal beam, posts, and, perhaps, one or more panels connected to the horizontal beam to form a wall. At least a portion of the lower edge of drape 701 is attached to the horizontal beam, perhaps in a manner such as described above.

This portico-joiner eliminates the need for interior posts or exterior A-frames whilst creating a much more structurally stable assembly. The portico-joiner provides more unobstructed interior space, uniformly supports the drape so that the loads are drawn to the posts and then to guy lines where they are conducted to the ground in the fashion disclosed above. Of course, it is possible to combine the various embodiments disclosed here to produce a compound tent structure having one end or both ends enclosed with a portico 704 as shown in FIG. 7. It is also possible to connect more than two tents using the portico-joiner approach. For instance, multiple joiners can be used to connect the ends of multiple tents to produce a structure in which the tents form radiating spokes that are all joined by the joiners to form a central hub.

Accordingly whilst this invention has been described with reference to preferred embodiments, various modifications of the illustrative embodiments will be apparent to those skilled in the art upon reference to this description and will therefore fall within the scope of the claims. The novel and non-obvious features of the invention may be, at least in part, summarized by the following enumerated statements.

Statement 1. The invention includes, in part, a portico for a saddle-shaped tent, wherein the saddle-shaped tent is of the type that has a canopy attached to a saddle-frame, the portico comprising a drape comprising a lower edge, wherein the drape hangs downward from the saddle-frame; and, a portico-frame comprising at least one horizontal beam, wherein the horizontal beam is attached to at least a portion of the lower edge of the drape.

Statement 2. The invention further includes the portico of Statement 1 wherein the portico-frame further comprises at least one post having an upper end and a lower end, wherein the upper end of the post is connected to the horizontal beam and wherein the lower end of the post is supported by a surface.

Statement 3. The invention further includes the portico of Statement 1 further comprising a panel.

Statement 4. The invention further includes the portico of Statement 3 wherein the panel comprises a window.

Statement 5. The invention further includes the portico of Statement 3 wherein the panel comprises a door.

Statement 6. The invention further includes the portico of Statement 3 wherein the panel is substantially vertically oriented.

Statement 7. The invention further includes the portico of Statement 1 further comprising a plurality of panels that form a portico wall.

Statement 8. The invention further includes the portico of Statement 1 wherein the horizontal beam comprises interconnecting sections.

Statement 9. The invention further includes the portico of Statement 1 wherein the horizontal beam comprises a keder rail and wherein the lower edge of the drape is held within a track in the keder rail.

Statement 10. The invention includes a saddle-shaped tent comprising the portico of Statement 1.

Statement 11. The invention includes a compound tent structure comprising a first saddle-shaped tent and a second saddle-shaped tent, wherein the first and the second saddle-shaped tents are juxtaposed in an end-to-end fashion, wherein the compound tent structure also comprises a portico interposed between an end of the first saddle-shaped tent and an end of the second saddle-shaped tent, wherein the portico comprises 1) a drape having a lower end, wherein the drape hangs downward from the first and the second saddle-shaped tents and connects the first saddle-shaped tent to the second saddle-shaped tent, and 2) a portico frame, the portico frame comprising a horizontal beam, wherein the horizontal beam is attached to at least a portion of the lower end of the drape.

Statement 12. The invention further includes the compound tent structure of Statement 11 wherein the portico-frame further comprises at least one post, the post having an upper end and a lower end, wherein the upper end of the post is connected to the horizontal beam and wherein the lower end of the post is supported by a surface.

Statement 13. The invention further includes the compound tent structure of Statement 11, further comprising at least one panel.

Statement 14. The invention further includes the compound tent of Statement 13 wherein the panel comprises a window.

Statement 15. The compound tent of Statement 13 wherein the panel comprises a door.

What I claim is:

1. A compound tent structure comprising:

a. a first saddle-shaped tent;

b. a second saddle-shaped tent;

wherein said first and said second saddle-shaped tents are juxtaposed in an end-to-end fashion; and c. a portico interposed between an end of the first saddle-shaped tent and an end of said second saddle-shaped tent, wherein said portico comprises:

i. a drape having a lower edge, wherein said drape hangs downward from said first and said second saddle-shaped tents and connects said first saddle-shaped tent to said second saddle-shaped tent; and ii. a portico-frame comprising at least two generally vertical posts and at least one horizontal beam defining an opening of such height and width to allow human beings to ingress into and egress from said compound tent structure, wherein said horizontal beam is attached to at least a portion of said lower edge of said drape such that said lower edge is attached to said beam along a portion of its length, wherein each of said posts has an upper end and a lower end, and wherein said upper end of each of said posts is connected to said horizontal beam and said lower end of each of said posts is supported by a surface.

2. The compound tent of claim 1 wherein said horizontal beam of said portico comprises a keder rail and wherein said lower edge of said drape is held within a track in said keder rail.

3. The compound tent structure of claim 2 wherein said portico, further comprises at least one panel.

4. The compound tent of claim 3 wherein said panel comprises a window.

5. The compound tent of claim 3 wherein said panel comprises a door.

6. A saddle-shaped tent comprising:

a frame including first and second arcuate frame members each having opposite ends, one end of the first frame member being supported by a surface adjacent one end of the second frame member, and the other end of the first frame member being supported by the surface adjacent the other end of the second frame member;

a canopy supported by the frame members such that the canopy forms a saddle shape and has opposite ends; and a portico on at least one end of the canopy including a drape hanging down from the end of the canopy, the drape having a lower edge, and a portico-frame comprising at least two generally vertical posts and at least one horizontal beam defining an opening of such height and width to allow human beings to ingress into and egress from the tent, wherein the horizontal beam is attached to at least a portion of the lower edge of the drape such that the lower edge is attached to the beam, wherein each of the posts has an upper end and a lower end, and wherein the upper end of each of the posts is connected to the horizontal beam and the lower end of each of the posts is supported by the surface.

7. The tent of claim 6 wherein said horizontal beam of said portico comprises a keder rail and wherein said lower edge of said drape is held within a track in said keder rail.

8. The tent of claim 7 wherein said portico further comprises a panel.

9. The tent of claim 8 wherein said panel comprises a window.

10. The tent of claim 8 wherein said panel comprises a door.

11. The tent of claim 8 wherein said panel is substantially vertically oriented.

12. The tent of claim 7 wherein said portico further comprises a plurality of panels that form a portico wall.

13. The tent of claim 7 wherein said horizontal beam of said portico comprises interconnecting sections.

* * * * *